US005860878A

United States Patent [19]

You

[11] Patent Number: 5,860,878

[45] Date of Patent: Jan. 19, 1999

[54] GAME RACKET HAVING HANDLE CAPABLE OF ABSORBING SHOCK

[76] Inventor: Chin-San You, No. 6, Lane 477, Sec. 2, Feng Yuan City, Taichung Hsien, Taiwan

[21] Appl. No.: 985,238

[22] Filed: Dec. 4, 1997

[51] Int. Cl.[6] ..... A63B 49/08

[52] U.S. Cl. ..... 473/549; 473/520; 473/523

[58] Field of Search ..... 473/549, 520, 473/521, 523, 564, 568, 559, 183, 168, 169, 173, 189, 193

[56] References Cited

U.S. PATENT DOCUMENTS

| | | | |
|---|---|---|---|
| 533,272 | 1/1895 | Burrows | 473/520 |
| 729,639 | 6/1903 | McCoy | 473/520 |
| 3,833,219 | 9/1974 | Dean | 473/523 |
| 4,082,273 | 4/1978 | Ellzey | 473/523 |
| 5,524,884 | 6/1996 | Haines | 473/521 |

FOREIGN PATENT DOCUMENTS

| | | | |
|---|---|---|---|
| 787326 | 9/1935 | France | 473/183 |
| 442975 | 2/1936 | United Kingdom | 473/183 |
| 458103 | 12/1936 | United Kingdom | 473/183 |
| 386 | 1/1986 | United Kingdom | 473/183 |

*Primary Examiner*—Raleigh W. Chiu
*Attorney, Agent, or Firm*—Browdy and Neimark

[57] ABSTRACT

A game racket has a handle formed of at least three suspension arms arranged side by side at an interval to form therebetween three slots parallel to the longitudinal axes of the suspension arms. The handle is provided with a shock-absorbing element having a body and a plurality of pieces extending from the body and corresponding in number to the slots. The shock-absorbing element is implanted in the handle such that the body is located in a common center of the slots, and that the pieces are located in the slots. The overall contact area between the shock-absorbing element and the handle is greatly expanded to enable the handle to alleviate the impact effectively.

20 Claims, 6 Drawing Sheets

GAME RACKET HAVING HANDLE CAPABLE OF ABSORBING SHOCK

FIELD OF THE INVENTION

The present invention relates generally to a game racket, and more particularly to a handle of the game racket. The handle is provided with a shock-absorbing body.

BACKGROUND OF THE INVENTION

As illustrated in FIGS. 1 and 2, a prior art game racket has a handle 11 which is provided with a shock-absorbing strip 12. Another prior art game racket has two arms 14 and 15, which are extended from a head frame 13 such that they are superimposed to form a handle of the game racket. The arms 14 and 15 are slightly twisted and provided therebetween with a shock-absorbing body 16.

The shock-absorbing strip 12 and the shock-absorbing body 16 are defective in design in that they are arranged respectively in a single planar surface, and that they are capable of absorbing the shock wave coming from a single direction, and further that they are incapable of absorbing the shock waves coming from various directions. As a result, the overall shock-absorbing effects of the strip 12 and the body 16 are seriously hampered.

SUMMARY OF THE INVENTION

The primary objective of the present invention is to provide a game racket handle with a shock-absorbing structure capable of mitigating effectively the shock waves imparted from the game racket head to the handle.

The objective, features, functions and advantages of the present invention will be more readily understood upon a thoughtful deliberation of the following detailed description of the embodiments of the present invention with reference to the accompanying drawings.

DETAILED DESCRIPTION OF THE INVENTION

Figure 1:
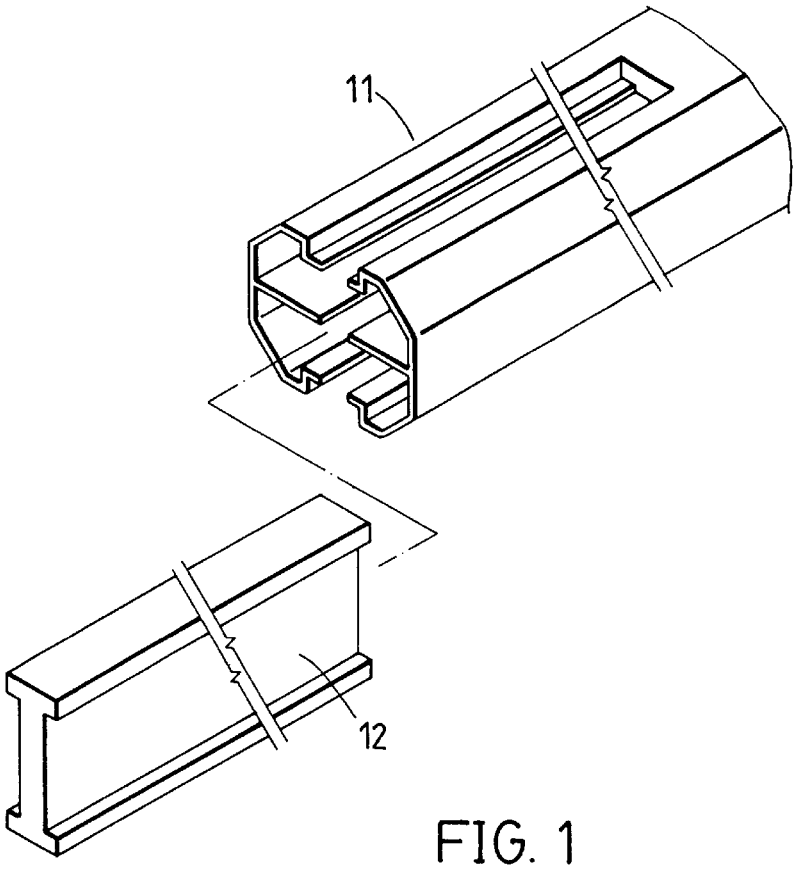
FIG. 1 PRIOR ART
FIG. 1 shows a schematic view of a shock-absorbing structure of the handle of a prior art game racket.
Figure 2:
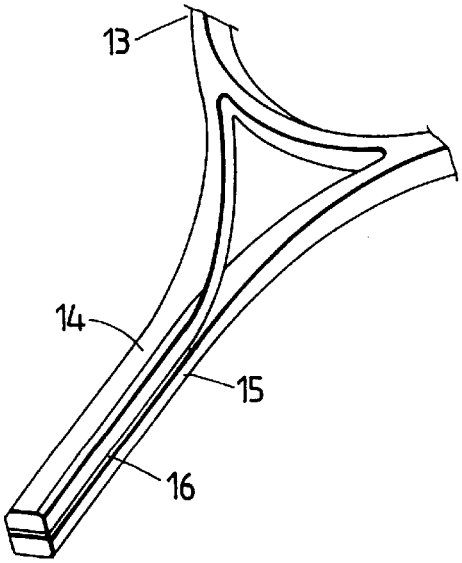
FIG. 2 PRIOR ART
FIG. 2 shows a schematic view of a shock-absorbing structure of the handle of another prior art game racket.
Figure 3:
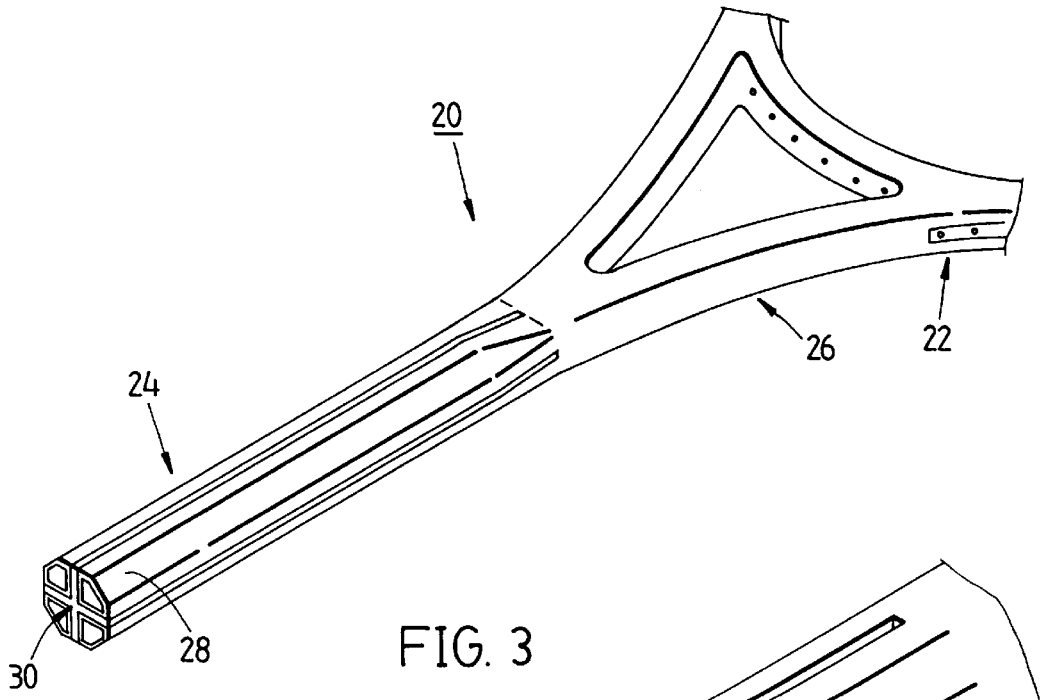
FIG. 3 shows a perspective view of a first preferred embodiment of the present invention.
Figure 4:
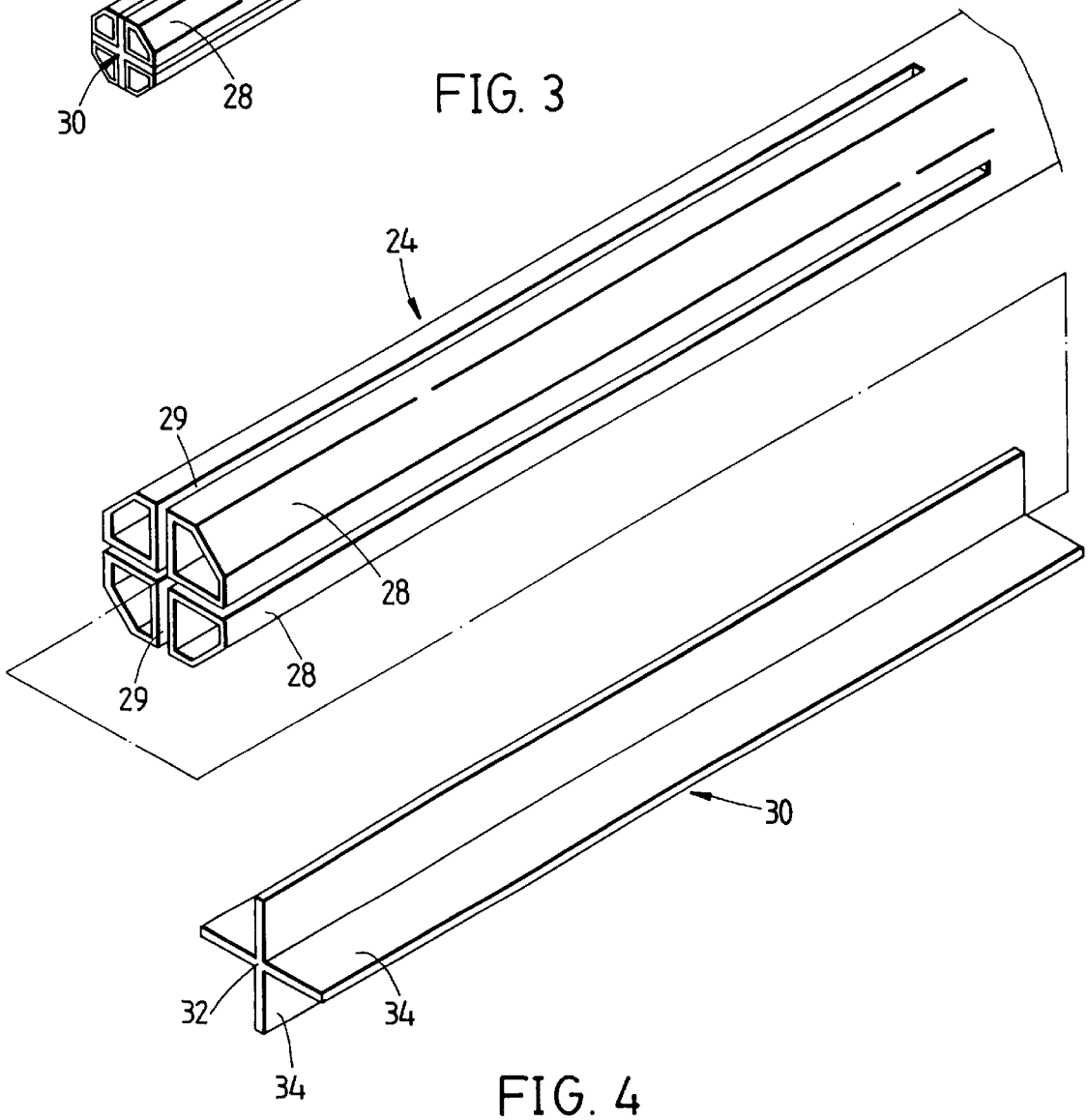
FIG. 4 shows a partial exploded view of the first preferred embodiment of the present invention.

As shown in FIGS. 3 and 4, a hollow game racket 20 formed from a composite material of epoxy resin and fiber cloth; of the first preferred embodiment of the present invention is composed of a head 22, a handle 24, and a throat 26 located between the head 22 and the handle 24. The handle 24 is formed of four suspension arms 28 in such a manner that two of the four suspension arms 28 are arranged side by side at an interval in the upper level, and that another two of the four suspension arms 28 are arranged side by side at an interval in the lower level, and that the upper level and the lower level are kept apart at an interval. Each of the intervals forms a slot 29 extending along the direction of the longitudinal axis of the handle 24. In other words, the cross section of the handle 24 shows that the slots 29 are arranged in a cruciform manner.

The handle 24 of the game racket 20 of the present invention is provided with a shock-absorbing element 30 which is made of a soft material i.e., softer then the material of racket 20. and is made up of a body 32. The body 32 has a cruciform cross section and consists of an upright piece 34 and a cross piece 34. The body 32 is located in the cruciform slot 29 of the handle 24. In the process of making the game racket 20 of the present invention by injection molding, the molten shock-absorbing element 30 is injected into the slots 29 of the handle 24. The upright and the cross pieces 34 of the shock-absorbing element 30 are uniform in thickness.

Figure 5:
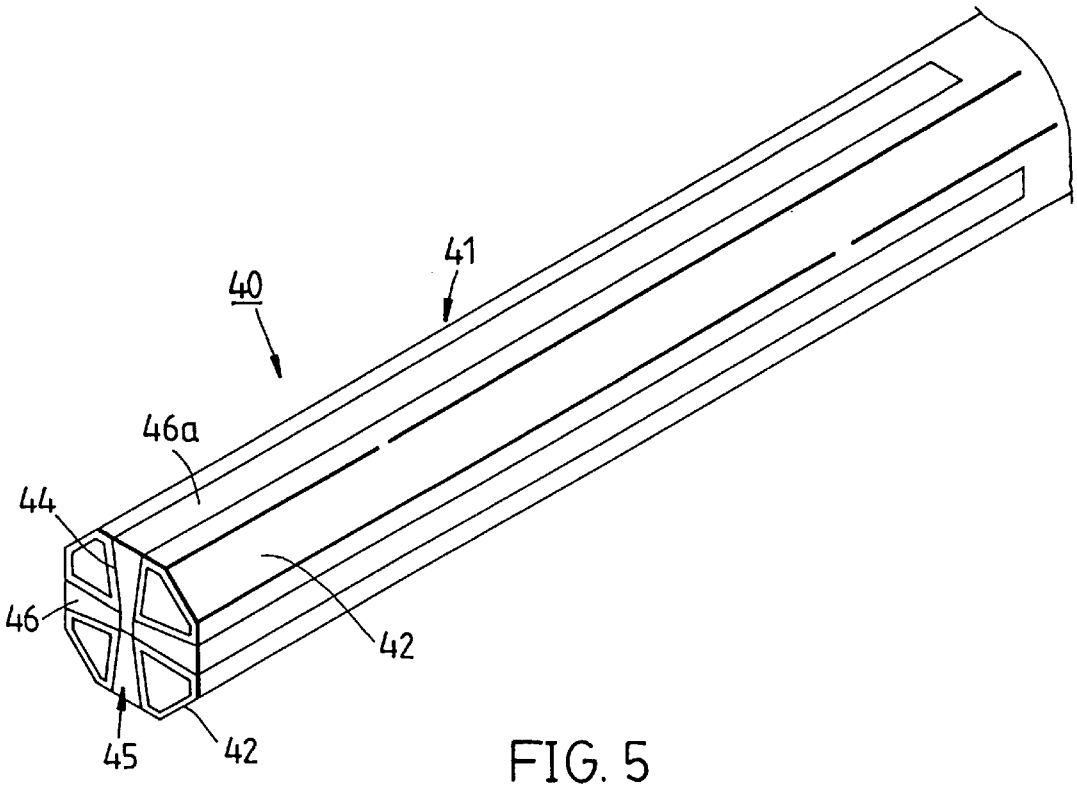
FIG. 5 shows a partial perspective view of a second preferred embodiment of the present invention.
Figure 6:
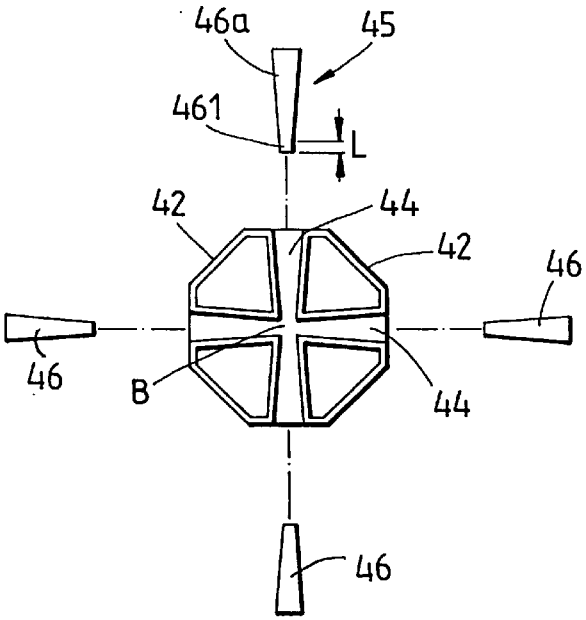
FIG. 6 shows an exploded view of the handle of the second preferred embodiment of the present invention.

As shown in FIG. 5, a game racket 40 of the second preferred embodiment of the present invention has a handle 41 which is basically similar to the handle 24 of the game racket 20 of the first preferred embodiment described above. The difference between the handle 41 and the handle 24 is that the former has slots 44 tapering toward the center of the handle 41. In addition, the handle 41 is provided with a shock-absorbing element 45 which is made up of three independent pieces 46 and one independent piece 46*a* as illustrated in FIG. 6. The pieces 46 are lodged in the slots 44. The piece 46*a* is provided at the tapered end thereof with an extension portion 461 of a length "L". The upright piece 46*a* is lodged in the slot 44 such that the extension portion 461 is located in a common center "B" of four slots 44.

Figure 7:
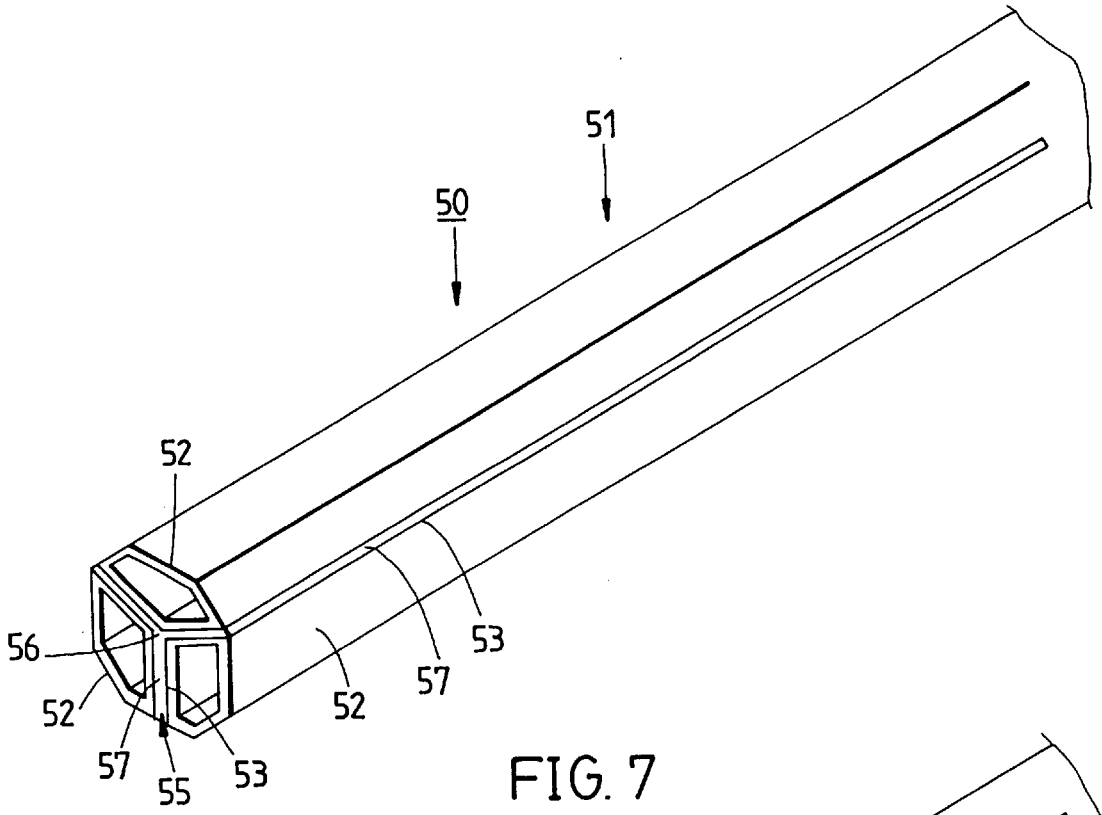
FIG. 7 shows a partial perspective view of a third preferred embodiment of the present invention.

As shown in FIG. 7, a game racket 50 of the third preferred embodiment of the present invention has a handle 51 which is formed of three suspension arms 52 and three slots 53 formed by the suspension arms 52. The cross section of the shock-absorbing element 55 shows that the body 56 of the element 55 is composed of three pieces 57 which are engaged to one another at a predetermined angle to have a Y-shaped cross section. One of the three slots 53 has a center line perpendicular to the string surface of the head of the game racket 50 while the remaining two slots 53 are set at angles to the string surface less than 90°.

Figure 8:
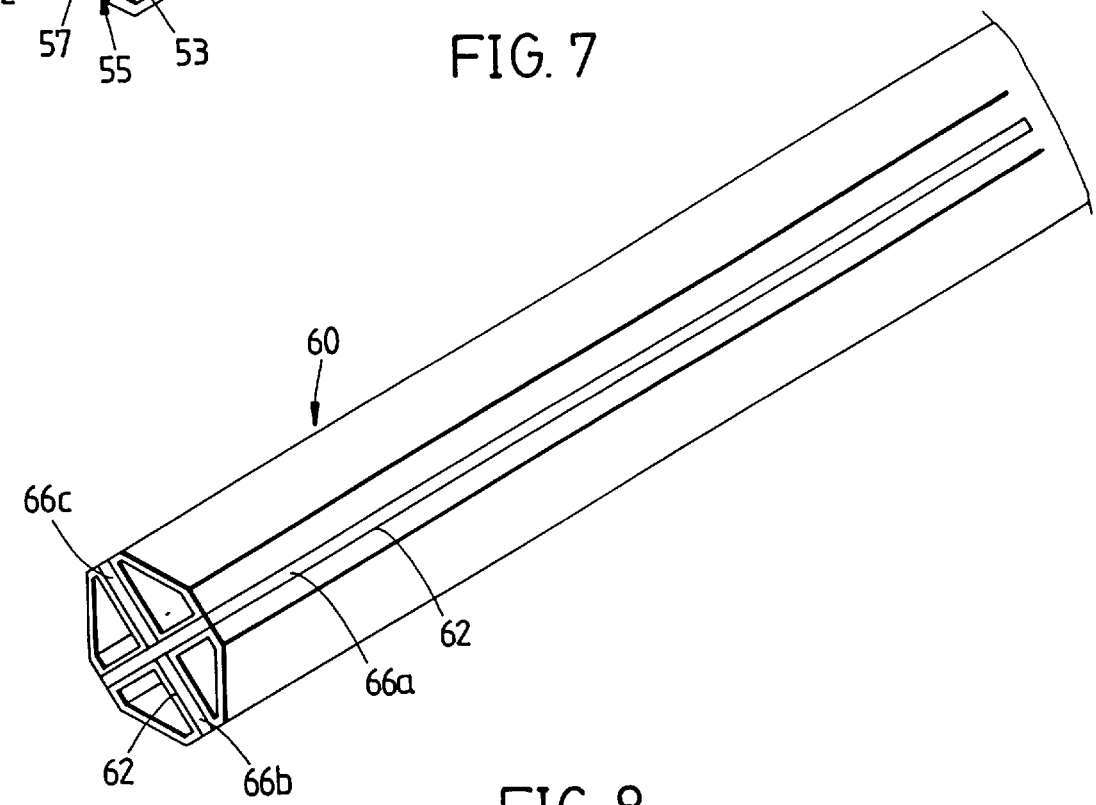
FIG. 8 shows a partial perspective view of a fourth preferred embodiment of the present invention.
Figure 9:
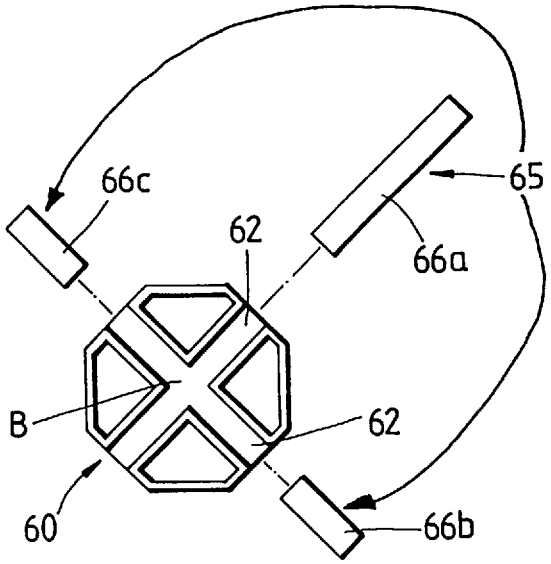
FIG. 9 shows an exploded view of the handle of the fourth preferred embodiment of the present invention.

Two of the four slots 29 of the first preferred embodiment of the present invention are parallel to the string surface of the head of the game racket 20, whereas another two of the four slots 29 are perpendicular to the string surface of the head of the game racket 20. The handle 60 of the fourth preferred embodiment of the present invention shown in FIG. 8 is provided similarly with four slots 62 which are arranged in a cruciform manner in cross section. However, the planar surface which is formed by two slots 62 forms a predetermined angle with the string surface of the game racket, as illustrated in FIG. 8. The handle 60 is provided with a shock-absorbing element 65 formed of three independent pieces 66*a*, 66*b* and 66*c*, which are less in number than the slots 62. The piece 66*a* has a radial length corresponding to the radial length formed by two slots 62 and common center B. Both pieces 66*b* and 66*c* have a radial length corresponding to a radial length of a single slot 62. In the process of making the handle 60, the piece 66*a* is lodged in a pair of slots 62 and the common center "B" of the slots 62. The pieces 66*b* and 66*c* are lodged respectively in the remainder of the slots 62, as illustrated in FIG. 9.

Figure 10:
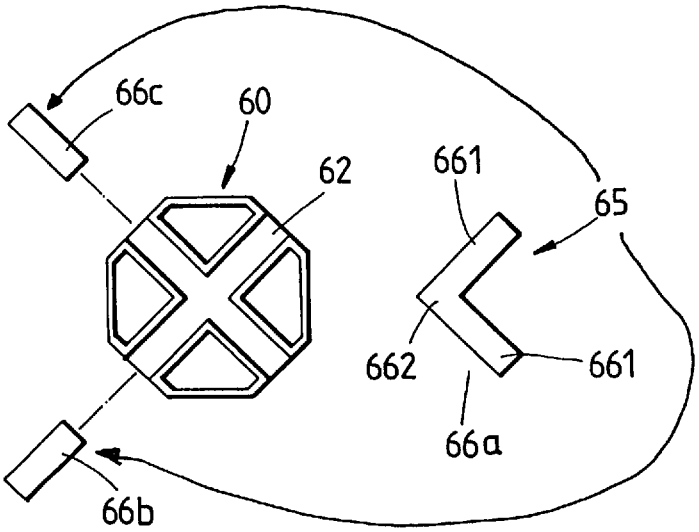
FIG. 10 shows a partial exploded view of a fifth preferred embodiment of the present invention.

As shown in FIG. 10, a shock-absorbing element 65 of the fifth preferred embodiment of the present invention is formed of pieces 66*a*, 66*b* and 66*c*, which are less in number than the slots 62. The 66*a* has two piece portions 661 forming therebetween a predetermined angle, and a connection portion 662 connected with one end of the piece portions 661. The piece portions 661 each have a radial length corresponding to the radial length of the slots 62. The piece portions 661 of the piece 66*a* are received in the two adjoining slots 62, whereas the connection portion 662 is received in the common center "B". The pieces 66*b* and 66*c* are lodged in the remainder of the slots 62.

Figure 11:
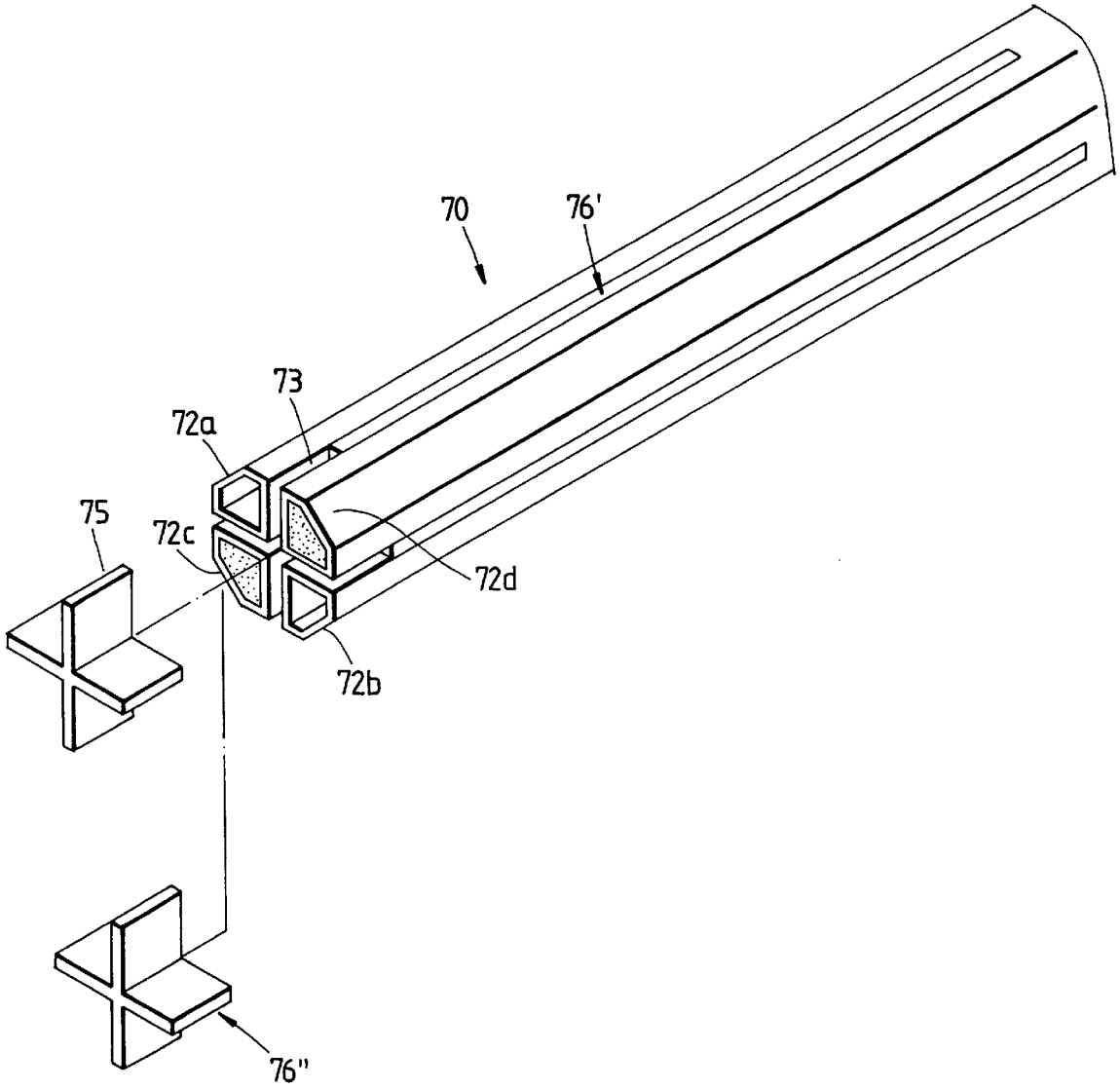
FIG. 11 shows a partial perspective view of a sixth preferred embodiment of the present invention.

As shown in FIG. 11, a game racket of 20 the sixth preferred embodiment of the present invention is made of a fiber composite material and is composed of a head, a throat, and a handle. The handle is formed of four suspension arms 72*a*, 72*b*, 72*c*, and 72*d* which are formed in a molding tool at a high temperature and under a high pressure. Before the game racket is formed in the molding tool, a preformed shock-absorbing element 76' is lodged in the slots 73 and the common center of the slots 73. A fastening device 75 is inserted into the gap located at the free ends of the slots 73 before the game racket is arranged in the molding tool. A high-pressure gas is filled between the suspension arms 72*a* and 72*b* while a foam material is filled in the suspension arms 72*c* and 72*d*. The molding tool is then subjected to a high temperature. Under the influence of the gas and the foam material, the game racket is formed such that the shock-absorbing element is adhered to the epoxy resin of the fiber cloth form the composite racket 20. The fastening device is located at the end of the handle 70 to ensure the precise formation of the suspension arms and the shock-absorbing element. The game racket is removed from the molding tool before the fastening device 75 is removed from the handle. The slots 73 are provided therein with an empty portion and a first section shock-absorbing element 76'. The empty portion is filled with a preformed second section shock-absorbing element 76", which is connected with the first section shock-absorbing element 76' to form the shock-absorbing element.

The shock-absorbing element of the present invention is capable of absorbing the shock waves coming from various directions in view of the greater contact area between the shock-absorbing element and the handle.

What is claimed is:

1. A hollow tubular game racket formed form a composite material comprising a head, a handle, and a throat located between said head and said handle; wherein said handle is formed of at least three hollow suspension arms arranged side by side at an interval such that fastening ends of said suspension arms engage said throat, and that a slot is formed between two adjoining suspension arms in such a manner that said slot is parallel to a longitudinal axis of said suspension arms and that said slot is corresponding in number to said suspension arms and further that said slots have a common center and still further that said slots form at least two planar surfaces forming respectively a predetermined angle along with a string surface of said head; and wherein said handle is provided with a soft shock-absorbing element having a body and pieces extending from said body and corresponding in number to said slots, said body of said shock-absorbing element being located in said common center such that said pieces are located in said slots.

2. The game racket as defined in claim 1, wherein said handle is provided with four suspension arms, four slots, and four pieces, said four slots being arranged in coplanar pairs such that two planar surfaces are formed by said pairs of said slots.

3. The game racket as defined in claim 2, wherein a first of said two planar surfaces is parallel to the string surface of the head, with a second of said two planar surfaces being perpendicular to the string surface of the head.

4. The game racket as defined in claim 2, wherein said two planar surfaces are set at a predetermined angle to the string surface of the head.

5. The game racket as defined in claim 2, wherein said two planar surfaces form an angle to said string surface less than 90°.

6. The game racket as defined in claim 2, wherein two of said suspension arms are filled with a foam material.

7. The game racket as defined in claim 1, wherein said handle is provided with three suspension arms and three slots, with at least one of said three slots being perpendicular to the string surface of the head.

8. The game racket as defined in claim 7, wherein a remaining two slots of said three slots form an angle to said string surface of less than 90°.

9. The game racket as defined in claim 1, wherein said pieces and said slots are uniform in thickness.

10. The game racket as defined in claim 1, wherein said pieces and slots have a width tapering from a radial outer side thereof toward a radial inner side thereof.

11. The game racket as defined in claim 1, wherein said shock-absorbing element has two sections.

12. The game racket as defined in claim 1, wherein said predetermined angle is less than 90°.

13. The game racket as defined in claim 1, wherein two of said suspension arms are filled with a foam material.

14. The game racket as defined in claim 1, wherein said shock-absorbing element comprises a first longitudinal portion and a second longitudinal portion, said second longitudinal portion being located in said slots at a distal end of said suspension arms.

15. A hollow tubular game racket formed from a composite material comprising a head, a handle, and a throat located between said head and said handle; wherein said handle is formed of at least three hollow suspension arms arranged side by side at an interval such that fastening ends of said suspension arms engage said throat, and that a slot is formed between two adjoining suspension arms in such a manner that said slot is parallel to a longitudinal axis of said suspension arms and that said slot is corresponding in number to said suspension arms and further that said slots have a common center and still further that said slots form at least two planar surfaces forming respectively a predetermined angle with a string surface of said head; and wherein said handle is provided with a soft shock-absorbing element softer than said said suspension arms having a predetermined number of pieces, with said pieces of said shock-absorbing element being located in said slots.

16. A hollow tubular game racket formed from a composition material comprising a head, a handle, and a throat located between said head and said handle; wherein said handle is formed of at least three hollow suspension arms arranged side by side at an interval such that fastening ends of said suspension arms engage said throat, and that a slot is formed between two adjoining suspension arms in such a manner that said slot is parallel to a longitudinal axis of said suspension arms and that said slot is corresponding in number to said suspension arms and further that each said slot has a common center and still further that said slots form at least two planar surfaces forming respectively a predetermined angle with a string surface of said head; and wherein said handle is provided with a soft shock-absorbing element having a predetermined number of pieces, with said pieces being located in said slots and said common center.

17. The game racket as defined in claim 16, wherein said pieces are corresponding in number to said slots, with at least one of said pieces having a radial length greater than a radial length of said slots and further having an extension portion located in said common center, with the remainder of said pieces having a radial length corresponding to a radial length of said slots.

18. The game racket as defined in claim 16, wherein at least two slots of said slots are opposite to form a planar surface; and wherein said pieces are at least one less in number than said slots, with one piece having a radial length corresponding to a radial width of a planar surface formed by said two slots, with said piece being located in said common center and with the remainder of said pieces being located in the remainder of said slots.

19. The game racket as defined in claim 16, wherein said pieces are at least one less in number than said slots, with one of said pieces having a cross section provided with two piece portions and a connection portion connected with one end of said piece portions, said piece portions forming a predetermined angle, said two piece portions being located in two of said slots and said connection portion being located in said common center, with the remainder of said pieces being located in the remainder of said slots.

20. The game racket as defined in claim 16, wherein said predetermined angle is less than 90°.

* * * * *